US006515589B2

(12) United States Patent
Schneider et al.

(10) Patent No.: US 6,515,589 B2
(45) Date of Patent: Feb. 4, 2003

(54) SCATTERING LIGHT SMOKE ALARM

(75) Inventors: Joachim Schneider, Nattheim (DE); Anton Pfefferseder, Sauerlach-Arget (DE); Bernd Siber, Glonn (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/960,019

(22) Filed: Sep. 21, 2001

(65) Prior Publication Data

US 2002/0080040 A1 Jun. 27, 2002

(30) Foreign Application Priority Data

Sep. 22, 2000 (DE) ..... 100 46 992

(51) Int. Cl.[7] ..... G08B 17/10

(52) U.S. Cl. ..... 340/630; 340/577; 340/578; 250/574

(58) Field of Search ..... 340/630, 577, 340/578, 552, 553, 554; 250/574

(56) References Cited

U.S. PATENT DOCUMENTS

| | | | | | |
|---|---|---|---|---|---|
| 5,225,810 | A | * | 7/1993 | Inoue et al. | 340/630 |
| 5,420,567 | A | * | 5/1995 | Schwarz | 340/630 |
| 5,502,434 | A | * | 3/1996 | Minowa et al. | 340/630 |
| 5,841,534 | A | * | 11/1998 | Lorenz | 340/630 |
| 6,011,478 | A | * | 1/2000 | Suzuki et al. | 340/630 |

* cited by examiner

*Primary Examiner*—Daniel J. Wu
(74) *Attorney, Agent, or Firm*—Michael J. Striker

(57) ABSTRACT

A scattering light smoke alarm has a light transmitter and a light receiver arranged so that a scattering point of the light transmitter and the light receiver are located outside the scattering light smoke alarm in a free space, a cover for protecting the light receiver and the light transmitter, and an element for distinguishing between smoke and other foreign bodies which are located in an area around the scattering point.

10 Claims, 4 Drawing Sheets

SCATTERING LIGHT SMOKE ALARM

BACKGROUND OF THE INVENTION

The present invention relates to a scattering light smoke alarm.

It is known to utilize scattering light smoke alarms. In the known scattering light smoke alarms the scattering point of a light emitter and a light receiver is located outside the scattering light smoke alarm. This has the advantage that no measuring chamber with a labyrinth must be provided. Smoke alarms with a labyrinth have the disadvantage that the labyrinth can be clogged with dirt. It is believed that such scattering light smoke alarms can be further improved.

SUMMARY OF THE INVENTION

In keeping with these objects and with others which will become apparent hereinafter, one feature of present invention resides, briefly stated, in a scattering light smoke alarm, in which the scattered light smoke alarm has a cover for protection of a light transmitter and a light receiver, and means for distinguishing between smoke and other foreign bodies, which is located in a region around the scattering point.

When the scattering light smoke alarm is designed in accordance with the present invention it has the advantage that a distinguishing between permanent foreign bodies in the scattering point of the scattered light smoke alarm and actual smoke is possible.

Such foreign bodies can be for example conductors which are cut off for manual works, or boxes which are stacked over one another. Also, spiders can make their nets in narrow shafts in the free space of the scattered light smoke alarm and by accident be located in the scattering point of the scattering light smoke alarm. The inventive scattering light smoke alarm recognizes such foreign bodies and eliminates them from the measuring signals, so that false alarm messages can be avoided.

In accordance with the present invention the means for distinguishing between smoke and other foreign bodies can include a processor for analysis of the time course of receiving signals of the light receiver, and the processor can be connected to the light receiver. With the time course it is advantageously possible to determine whether smoke or another foreign body is located in the scattering light smoke alarm. With smoke an increasing intensity of the scattering light signal is registered with increasing time, while when a foreign body penetrates in the scattering point a jump function occurs over a short time, and then again is drawn in a fixed signal. This distinguishing with respect to a jump in the time function makes possible the distinguishing in a simple manner between smoke and another foreign body. Therefore there is also an advantage that an available scattering light smoke alarm must be just completed with a software, which performs this time analysis of the receiving signal of the light receiver. Thereby the inventive scattering light smoke alarm can be realized in a simple manner.

In accordance with another embodiment of the present invention, it is advantageous when an optical element, preferably a facet mirror is arranged around the light receiver, to couple the scattering signals in the light receiver from a region area around the scattering point. The total signal at the light receiver is an integral of the signals from all scattering regions in this area. With a suitable facet mirror it is possible to detect many scattering regions which are located spatially apart from one another, in which the alarm sensibly reacts to scattering light. When smoke is present, then all scattering regions homogeneously with the corresponding smoke density supply a portion of a scattering light signal, while a spider locally scatters a partial signal at the receiver. With such an arrangement, by simple amplitude comparison, a spider can be distinguished from smoke.

In a further advantageous embodiment of the scattering light smoke alarm of the present invention, is formed so that the distinguishing between smoke and another foreign body is made possible in that the light source is formed with adjustable wave lengths. Thereby advantageously the effect is utilized that with the Rayleigh scattering, the scattering condition is independent from the wavelength of the radiation. With the use of a variable frequency laser, in presence of smoke particles, different signal intensities as a function of the wavelength are obtained for the Rayleigh scattering. For particles which are large relative to the wavelength, the scattering does not depend or depends only insignificantly from the wavelength, and therefore with a variable frequency of the light transmitter no significant effect with the scattering signals occurs. With small particles such as smoke particles, this effect of the intensity variation in dependence on the wavelengths is significantly measurable. Thereby it is advantageously possible to distinguish such smoke particles from larger particles. This distinguishing is then performed by a processor in the inventive scattering light smoke alarm.

A further advantage resides in that the light transmitter can be connected with an amplitude modulator. Amplitude-modulated light signals make possible on the one hand due to the phase shift between transmitted and received signals which are the pulses which are produced from the amplitude modulation, a distance determination of the scattering object, while a pulse widening or in other words a dispersion is measured for a diffusing scattering body which is first of all a smoke cloud. Thereby in advantageous manner it is possible that, in dependence on the pulse widening, it can be determined whether smoke or another foreign body is present.

Finally, in accordance with another embodiment of the present invention it is advantageous that the scattering light smoke alarm has an ultrasound sensor which contains a transmitter and a receiver. The ultrasound sensor can be arranged so that the ultrasound sensor monitors the area around the scattering point. The ultrasound sensor monitors thereby advantageously the optical scattering region of the scattering alarm. If a solid foreign body is located in the scattering region, the ultrasound sensor and the scattering light sensor receive a signal. If smoke is located in the scattering point, only the scattering light sensor receives a signal, but not the ultrasound sensor. For this purpose ultrasound sensors with operating megahertz region are suitable, since these ultrasound sensors have a very good directional action. By means of the ultrasound sensor it is further advantageously determined whether a foreign body is located in a region around the smoke alarm, which possibly indicates an influence of the current condition for the fire detection. This can be outputted as a warning for the central unit.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Scattering light smoke alarms which are used as fire alarms have the advantage that, they are independent from of interfering light sources, dust, dirt, insects, short time smoke clouds, and short time introduced foreign bodies in the measuring point, such as for example cleaning devices. Long time smoke clouds such as those produced during a fire, are recognized by the scattering light smoke alarms for a substantial scattering signal as a fire recognition signal, for example by comparing with a predetermined threshold volume. When objects are located for long time in the measuring point which is the scattering point, the scattering light smoke alarm however operationally produces a fire message.

In accordance with the present invention a scattering light smoke alarm is suggested, which is provided with means for distinguishing between smoke and other foreign bodies. Such means include in particular a processor which analyses the time course of receiving signals of the light receiver. Other possibilities include the use of faucet mirrors to detect an area around the scattering point, a photo receiver array for obtaining a location, resolution, a frequency-variable light source for detecting wavelength-dependent scattering signals, an amplitude modulator for providing via amplitude-modulated light signals the distinguishing between foreign bodies and smoke, and an ultrasound sensor for monitoring the area around the scattering point.

Figure 1:
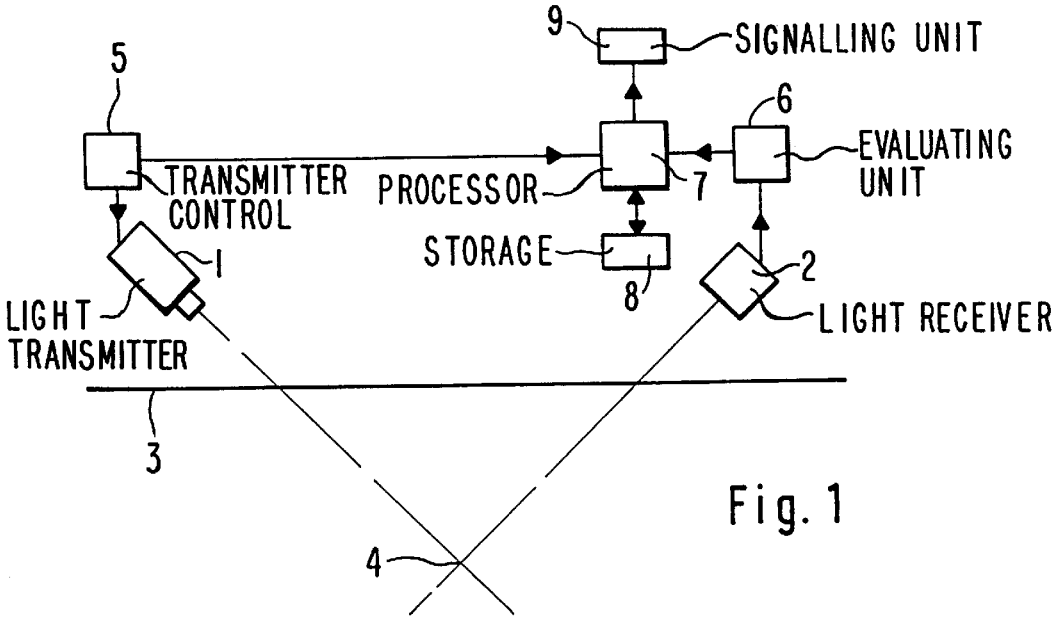
FIG. 1 is a view showing a scattering light smoke alarm in accordance with a first embodiment of the present invention.

FIG. 1 shows a first embodiment of the inventive scattering light smoke alarm as a block diagram. A cover 3 protects the scattering light smoke alarm, from moisture, aggressive gases and mechanical damages. The cover 3 is formed as a transparent synthetic plastic. Alternatively it is possible to use glass. The cover 3 is formed so that it is transparent for the light for the scattering light measurement. It can thereby operate as a filter for undesired interference radiation. In particular when infrared radiation is utilized, the surrounding air is easily filterable through the cover 3 and the light receiver 2. A light transmitter 1, here a light diode in infrared region, is located behind the cover 3. Alternatively, it is also possible to use a laser, for example a semi-conductor laser, and/or other wavelength regions, which is controlled by a transmitter control unit 5. The transmitter control unit 5 is therefore a driver circuit for the light transmitter 1. In case of a laser, a typical laser driver circuit with temperature-and working point compensation is provided. The control unit 5 is connected with a processor 7 through a second output.

The processor 7 is connected with a storage 8 via a data input/output in which permanently stored reference signals are stored and used for storage of intermediate values. Through a second data input, the processor 7 is connected with a receiver evaluating unit 6. The processor is connected through a data output with a-signaling device 9. An input of the receiver evaluating unit 6 is connected with a light receiver 2. The light receiver 2 is here a photo diode. The light diode 1 and the photo diode 2 are arranged so that a scattering point 4 is located outside of the scattering light smoke alarm in a free area.

In the scattering point 4 it is detected whether smoke is present or not. If the smoke is present, it is recognized by scattering signals by the photo diode 2 and the processor 7 performs with the signaling device 9 a signaling about a fire. The receiver evaluating device 6 is here receiving amplifier and an analog/digital converter. The signaling device 9 can be a light, a siren or a communication block which transmits the signal to a central unit, for example through a bus. This is especially advantageous when several scattering light smoke alarms are utilized, which are connected through the bus with a central unit to perform a central monitoring of a building.

The processor 7 performs a time course analysis of the receiving signals of the photo diode 2. If smoke occurs in the scattering point 4, this leads to a continuous increase of intensity of the receiving scattering light by the photo diode 2. If however a foreign body is brought in the scattering point 4, then with introduction of the foreign body in the scattering point 4 a jump in the time course of the intensity function of the received signals by the photo diode 2 occurs, and after the introduction and staying of the foreign body in the scattering point, then a flat signal plateau is produced. A short exchange of a foreign body in the scattering point 4 causes a short pulse in the receiving function of the control signals and thereby is recognized as a signal which is not used for alarm release.

When in the time function of the intensity of the receiving signals there is a jump, this can be traced to an introduction of a foreign body. This can be recognized by a software with the processor 7, and then it is transmitted through the communication block 9 to the central unit, to provide a message that the scattering light smoke alarm due to a foreign body no longer operates in an orderly fashion, so that the optimal flow conditions are again produced.

Other signals are for example signals which can be expected with spider nets or a spider directly in the scattering point. With the slow production of a spider net, the structure of the spider net is compensated by the drift compensation which is conventional in the scattering light smoke alarms. The conventional drift compensation resides in that, very slow signal changes are suppressed in the region of 6–8 hours. The simplest embodiment is a high pass with its correspondingly small time Constance. A drift occurs in conventional fire alarms by aging of the components and in particular by a slow dirtying of the labyrinth interior. Thereby quiescent value follow up is realized.

Variations of the spider net, for example by an air draft, can lead to interference signals, or when the spider moves slowly in the scattering point, this can lead to fraudulent signals. This leads however to a bend in the intensity function, so that such intensity jumps are recognizable by the processor 7.

Figure 2:
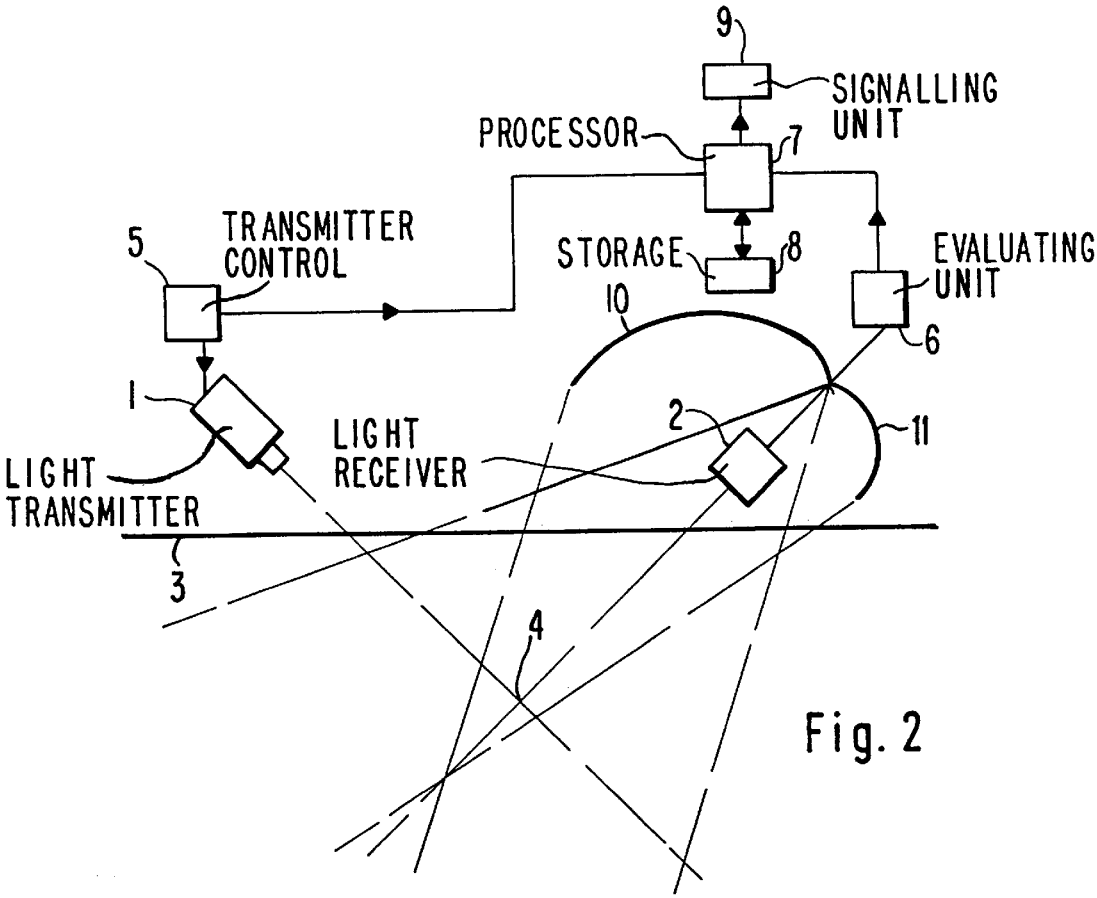
FIG. 2 is a view showing a scattering light smoke alarm in accordance with a second embodiment of the present invention with a faucet mirror.

FIG. 2 shows a second embodiment of the inventive scattering light smoke alarm. A faucet mirror composed of two concave mirrors (hollow mirror segments) 10 and 11 is arranged around the light receiver 2. The concave mirrors 10 and 11 collect light from an area around each scattering point and couple it into the light receiver 2. The scattering point or the scattering points are exactly taken volume regions where the light beam of the radiation source and the receiving beam of the light receiver intersect. Four scattering points are provided here, since for the optical axes of the both mirrors 10 and 11, as well as the optical axis of the light transmitter 1, two intersecting points are provided.

The light receiver 2 is sensitive all around, so that the light receiver 2 can be assembled of several diodes which can receive the light from different directions. The cover 3 protects the scattering light smoke alarm from outside actions.

The light receiver 2 is connected through its output with the receiving evaluation unit 6, which is connected through its data output with the processor 7. The processor 7 is connected through a data input/output with the storage 8. Through a data output, the processor 7 is connected with the signaling device 9. The transmitter control unit 5 is connected to a second data input of the processor 7. A second output of the transmitter control unit 5 leads to the light transmitter 1, which is here again a light diode. Furthermore, a laser can be used as well.

With the use of the concave mirrors 10 and 11 as facette mirror, the integral from the detected control regions is formed by the light receiver 2. With the presence of smoke, all scattering regions are substantially homogeneously supplied with a corresponding smoke density as a part of the scattering light signal, while a spider scatters only locally a partial signal at the receiver. With such an arrangement, with a simple amplitude comparison of the receiving signals by the processor 7, a spider as a foreign body can be distinguished from smoke. The evaluation can be performed in particular by an evaluation of the time signal. Smoke produces a continuous signal, while an insect as an example for a foreign body produces a signal jump when it leaves and enters each segment. An insect produces a pulse sequence during passing through the scattering region. Therefore a threshold value is provided in the storage 8, which gives a threshold for the amplitude, from which the smoke can be recognized. A spider produces a signal which is located under the threshold value. The threshold value is determined from experimental data.

Figure 3:
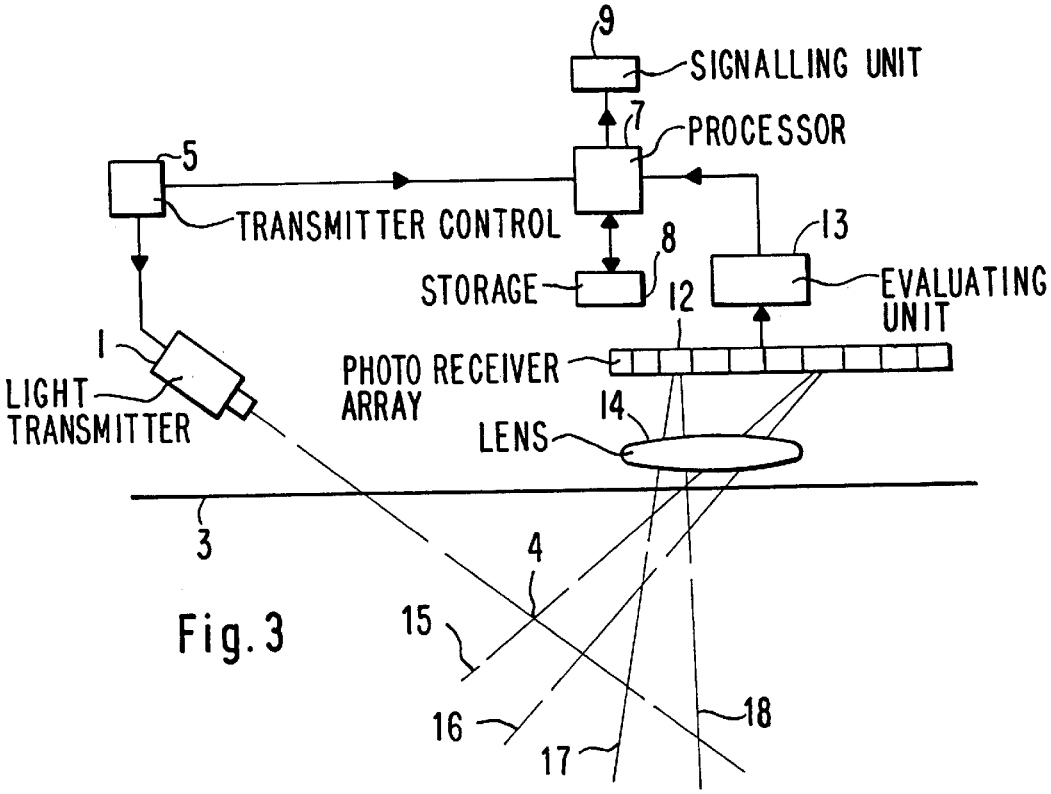
FIG. 3 is a view showing a scattering light smoke alarm in accordance with a third embodiment of the present invention with a photo receiver array.

FIG. 3 shows a second embodiment of the inventive scattering light smoke alarm. The cover 3 protects again the scattering light smoke alarm from outer actions. The light sensor 1 is connected through its input with the transmitter control unit 5. The transmitter control unit 5 is connected through a second output with the processor 7. The processor 7 is connected through a data inpu/output with the storage 8. A photo receiver array evaluating unit 13 is connected to a second data input of the processor 7. A signaling device 9 is connected to a data output of the processor 7. The photo receiver array evaluating unit 13 is connected through its input with a photo receiver array 12. The photo receiver array 12 is composed from a field of photo diodes. Alternatively also a charged coupled device (CCD) cell, a charged couple device (CCD) matrix or a CMOC matrix can be used. A lense 14 is arranged between the cover 3 and the photo receiver array 12. The lens 14 is arranged so that the photo diodes of the photo receiver array 12 detects several local regions around the scattering point 4.

The photo receiver array evaluating unit 13 inquires the individual signals of the photo diodes and digitalized them, to transmit them then to the processor 7, which thereby performs a local release of the receiving signals around the scattering point 4. It is thereby possible to measure not only the integral of the receiving signals from the area around the scattering point 4, but also to obtain with the lens 14 a location distribution of the signals. The beams 15, 16, 17, and 18 for example show two location regions which are detected by the photo receiver diode array 12. By this location resolution it is possible to clearly distinguish between smoke which is homogenous, small animals which change only individual regions, and objects. With objects which are somewhat greater, the receiving intensity signals between two photo diodes of the photo receiver array cause a jump in the receiving light intensity. Furthermore, it is possible that with the penetration of an object, several photo diodes of the photo receiver array are moved. through and thereby a typical signal pattern is produced in time distance, which can make a conclusion about the penetration of an object in the scattering field of the scattering light smoke alarm.

Figure 4:
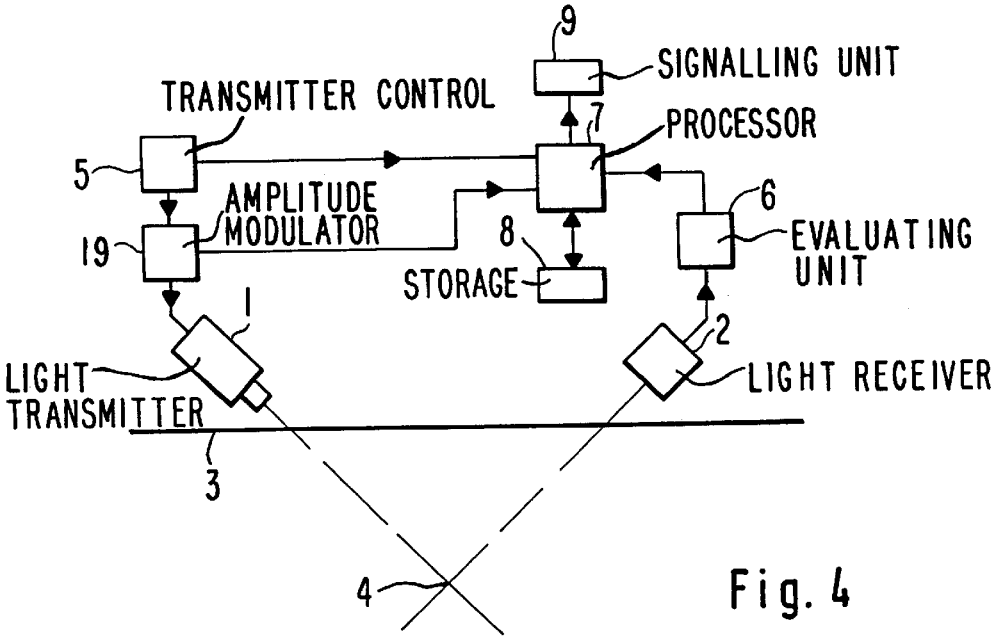
FIG. 4 is a view showing a scattering light smoke alarm in accordance with a fourth embodiment with an amplitude modulator.

FIG. 4 shows a fourth embodiment of the inventive scattering light smoke alarm. The cover 3 again protects the scattering light smoke alarm from outer actions. The light transmitter 1 is connected through its input with an amplitude modulator 19. A data output of the amplitude modulator 19 leads to a first data input of the processor 7. The transmitter control unit 5 is connected to a data input of the amplitude modulator 19. A second output of the transmitter-control unit 5 leads to a second data input of the processor 7. The processor 7 is connected through its third data input with the receiver evaluation unit 6. Through a data input/output, the processor 7 is connected with the storage 8. The signaling device 9 is connected via a data output of the processor 7. The light receiver 2 is connected to an input of the receiver evaluating unit 6. The light transmitter 1 and the light receiver 2 are arranged so that the scattering point 4 is located outside of the scattering light smoke alarm in a free area.

The amplitude modulator 9 forms from the electrical signal of the transmitter control unit 5, a pulse sequence and thereby performs an amplitude modulation. In the simplest form, this is simply a switch, so that a sequence is produced by periodic light pulses in the light transmitter 1, and again a dark testing is performed and this is done alternatingly in a cycle which is given by the amplitude modulator 19. The processor 7 evaluates the receiving signals in comparison to the transmitted signals which the amplitude modulator 9 directly transmits to the processor 7. Thereby the processor 7 is in a position on the one hand to perform a distance determination based on the phase shift between the transmitted and received pulses, and on the other hand to determine whether a smoke cloud or an object is present. If outside air is not located in the scattering point 4 no signals are scattered and the receiver 2 receives only the surrounding light, which, with the corresponding selection of the light wavelength or the light wavelength region, can be compensated by a corresponding selection of the light wavelength or the wavelength region, as well as by (an electronic) direct light suppression.

Figure 6:
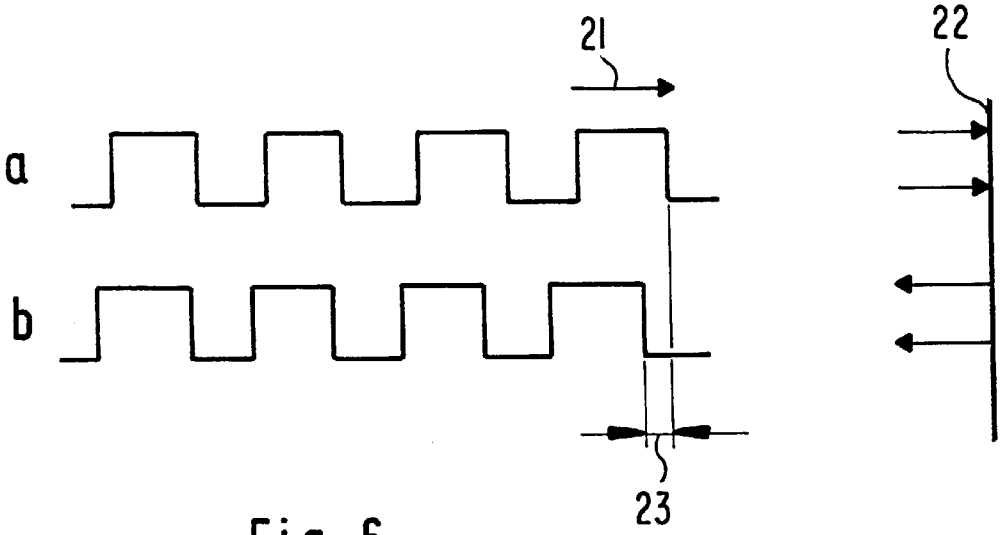
FIG. 6 is a view showing an amplitude-modulated optical signal for determination of a distance, of the inventive scattering light smoke alarm.
Figure 7:
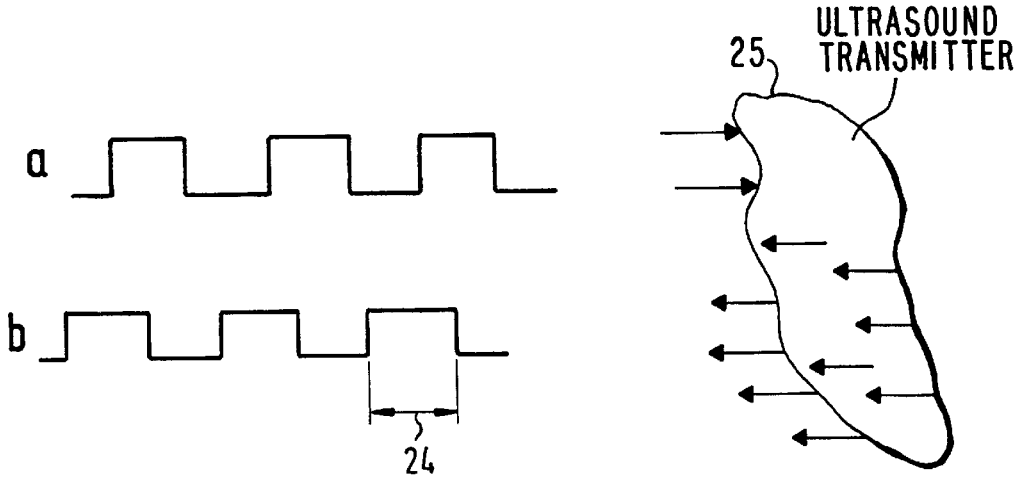
FIG. 7 is a view showing an amplitude-modulated optical signal for identification of a smoke cloud, of the inventive scattering light smoke alarm.

FIG. 6 shows how the pulse sequences which are transmitted and which are received, are different in the phase. FIG. 6*a* shows the transmitted pulse sequence which is identified by the arrow 21 and falls on the reflection plane 22. FIG. 6*b* shows the received pulse sequence. It can be seen from a time comparison that the phase shift 23 occurs. The phase shift 23 is a measure for the distance from the light transmitter and receiver to the reflection plane 22. FIG. 7*a* again shows a transmitted pulse sequence which acts on a smoke cloud 25. FIG. 7*b* to the contrary shows the received pulse sequence from the smoke cloud 25. Since in the smoke cloud 25 many scattering sectors are provided, the pulses of the transmitted pulse sequence A widen and it leads to a pulse dispersion as shown in FIG. 7*b*. The width of the received pulses in FIG. 7*b* is a measure of whether smoke is present or not. This can be determined by a threshold value comparison with the processor 7. The threshold value is then provided and stored in the storage 8.

A further embodiment for distinguishing of objects from a smoke cloud resides in the use of a light source with a variable frequency wavelength as a light transmitter 1. For example a variable frequency semiconductor laser in an infrared region can be utilized, which provides a variable frequency over a predetermined wavelength region, to recognize whether the scattered light signals are dependent from the wavelength. This scattering is known as Rayleigh scattering. With small particles such as those present in a smoke cloud, the Rayleigh scattering is wavelength-dependent. The processor 7 is thereby informed via the transmitter control unit 5 about the instantaneous utilized wavelength, to analyze then the received signals as a function of the transmitter wavelength. If this function is horizontal or an approximately horizontal, then an object is introduced into the scattering point 5, since large objects which are in particular large when compared with the utilized wavelength, have no intensity dependency from the wavelength. Thereby a clear detection is possible whether a foreign body or smoke is present in the area around the scattering point 5.

In addition to a variable frequency laser, it is also possible to use a lamp which emits light with various wavelengths, and via a filter then selects these individual wavelengths.

Figure 5:
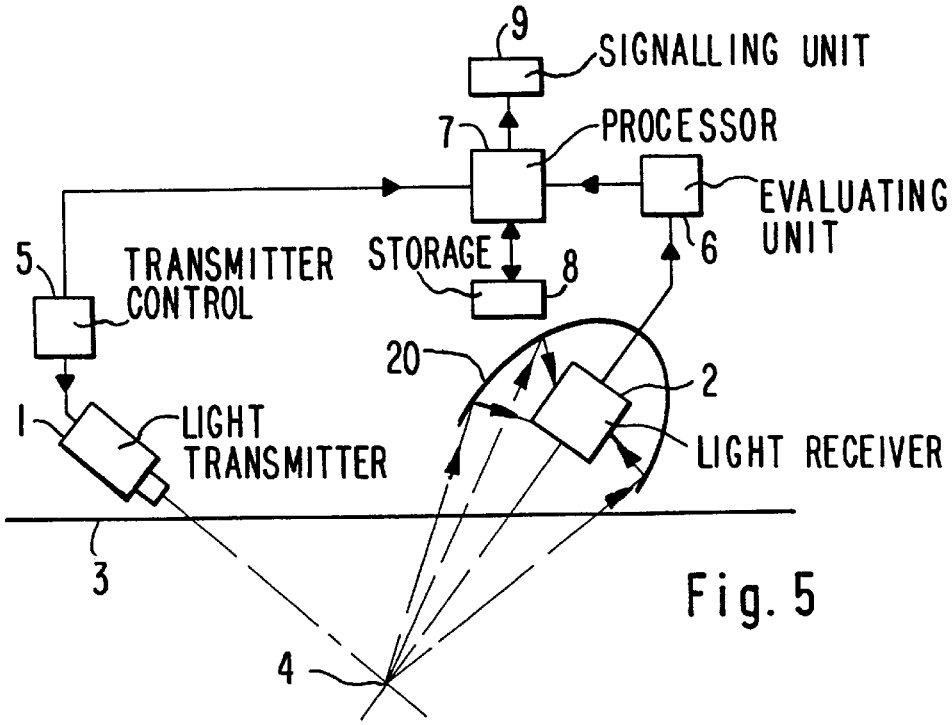
FIG. 5 is a view showing a scattering light smoke alarm in accordance with a fifth embodiment of the present invention, with an ellipsoid.

FIG. 5 shows a fifth embodiment of the inventive scattering light smoke alarm. The cover 3 again protects the scattering light smoke alarm from outer actions. The light transmitter 1 is connected through its input with the transmitter control unit 5, while the transmitter control unit 5 is connected via a data output with a first data input of the processor 7. The processor 7 is connected through a data input/output with the storage 8. Through a second data input the processor 7 is connected with the receiver evaluating unit 6. A data output of the processor 7 is connected to a signaling device 9. The signaling device 9 is connected to a data output of the processor 7. The light receiver 2 is connected to an input of the receiver evaluating unit 6. An ellipsoid 20 is arranged around the light receiver 2 and serves for coupling as much scattered light as possible into the light receiver 2. This improves the signal-to-noise ratio of the scattering light smoke alarm. An alternative method is to use a more intense light transmitter 1.

Figure 8:
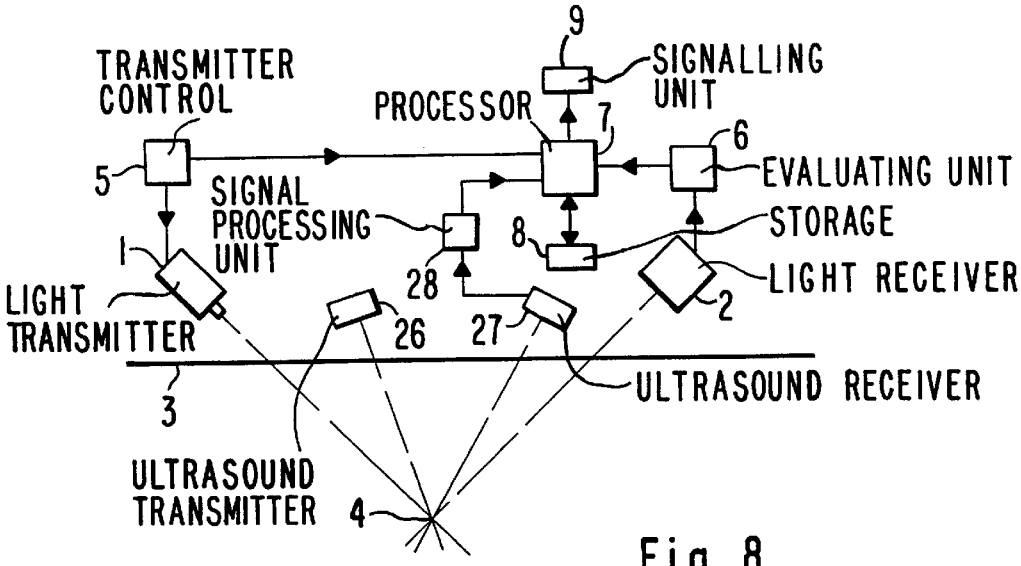
FIG. 8 is a view showing a scattering light smoke alarm in accordance with the present invention, with an ultrasound detection for foreign bodies.

FIG. 8 shows the inventive scattering light smoke alarm with an ultrasound detection. Light sensor 1 and the light receiver 2 are arranged so that the scattering point 4 is located outside the scattering light smoke alarm in a free space. The cover 3 protects the scattering smoke alarm from outer actions. The transmitter control unit 5 is connected to an input of the light transmitter 1. A data output of the transmitter control unit 5 leads to a first data input of the processor 7. A signal processing unit 28 is connected to a second data input of the processing 7, while an ultrasound receiver 27 is connected to the other input. The ultrasound receiver is oriented to the scattering point 4, to which also an ultrasound transmitter 26 is oriented. The ultrasound transmitter is operated either continuously or in periodic time intervals.

The receiving evaluating unit 6 is connected to a third input of the processor 7. The signaling unit 9 is connected to a data output of the processor 7. The processor 7 is connected with the storage 8 through a data input/output. The light receiver 2 is connected to an input of the receiving evaluating unit 6.

If a foreign body is located in the area around the scattering point 4, then both the light receiver 2 and also the ultrasound receiver 27 receive signals, so that the processor 7 because of the receiving signal from the signal processing unit 28 which amplifies and digitalizes the receiving signals from the ultrasound receiver 27, recognizes that a foreign body is present and not a smoke which causes the scattering signals received by the light receiver 2. Thereby the optical receiving signal is monitored by the ultrasound receiving signal. When smoke is present, the scattering signals are caused in the scattering point 4, and then the ultrasound receiver receives no receiving signal. Ultrasound waves provide for the possibility to expose an area to ultrasound waves, so that faulty signals are improbable.

The functions of an ultrasound transmitter and receiver can be integrated in one component. First an ultrasound pulse is radiated. Then it is converted to reception, and a signal reflected by an available object is expected (echo) operation.

It will be understood that each of the elements described above, or two or more together, may also find a useful application in other types of constructions differing from the types described above.

While the invention has been illustrated and described as embodied in scattered light smoke alarm, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A scattering light smoke alarm, comprising a light transmitter and a light receiver arranged so that a scattering point of said light transmitter and said light receiver are located outside the scattering light smoke alarm in a free space; a cover for protecting said light receiver and said light transmitter; and means for distinguishing between smoke and other foreign bodies which are located in an area around said scattering point.

2. A scattering light as defined in claim 1, wherein said means for distinguishing between smoke and other foreign bodies includes a processor for analysis of a time course of receiving signals of said light receiver, said processor being connectable to said light receiver.

3. A scattering light as defined in claim 1, wherein said means for distinguishing between smoke and other foreign bodies includes optical means provided on said light receiver which couple scattering signals from several scattering regions in one area around the scattering into said light receiver.

4. A scattering light as defined in claim 3, wherein said optical means include a facette mirror.

5. A scattering light as defined in claim 1, wherein said light receiver is formed as a photo receiver array having at least two photo receiver elements.

6. A scattering light as defined in claim 5, and further comprising a lense system arranged before said photo receiver array.

7. A scattering light as defined in claim 1, wherein said light transmitter is formed as a variable frequency light source, said variable frequency light source, depending on scattering signals from a transmitter control, emitting light with a changeable wavelength.

8. A scattering light as defined in claim 1, and further comprising an amplitude modulator connectable with said light transmitter.

9. A scattering light as defined in claim 1, and further comprising an ultrasound sensor having an ultrasound transmitter and an ultrasound receiver, said ultrasound sensor being arranged so that it monitors an area around said scattering point.

10. A scattering light as defined in claim 9, wherein said ultrasound sensor is operatable with an echo operation.

* * * * *